US005159813A

United States Patent [19]

Yoshimatsu et al.

[11] Patent Number: 5,159,813

[45] Date of Patent: Nov. 3, 1992

[54] SLEWING CONTROL DEVICE FOR CRANE

[75] Inventors: Hideaki Yoshimatsu, Akashi; Koichi Fukushima, Kobe, both of Japan

[73] Assignee: Kabushiki Kaisha Kobe Seiko Sho, Kobe, Japan

[21] Appl. No.: 622,777

[22] Filed: Dec. 5, 1990

[30] Foreign Application Priority Data

Apr. 25, 1990 [JP] Japan ..... 2-111246

[51] Int. Cl.[5] ..... F16D 31/02

[52] U.S. Cl. ..... 60/459; 60/466; 60/460; 60/468; 60/493; 60/494

[58] Field of Search ..... 60/459, 460, 461, 464, 60/466, 468, 493, 494

[56] References Cited

U.S. PATENT DOCUMENTS

| | | | |
|---|---|---|---|
| 4,194,365 | 3/1980 | Stoufflet et al. | 60/494 X |
| 4,520,625 | 6/1985 | Sato et al. | 60/494 X |
| 4,586,332 | 5/1986 | Schexnayder | 60/468 |
| 4,644,849 | 2/1987 | Tanaka | 60/466 X |
| 4,845,948 | 7/1989 | Tha et al. | 60/460 X |
| 4,887,428 | 12/1989 | Iino | 60/468 |
| 4,930,311 | 6/1990 | Dantigraber | 60/466 X |
| 5,046,311 | 9/1991 | Cartner | 60/494 X |
| 5,058,383 | 10/1991 | Tsunemi et al. | 60/493 |
| 5,062,266 | 11/1991 | Yoshimatsu | 60/466 |
| 5,063,742 | 11/1991 | Yoshimatsu | 60/468 |
| 5,081,838 | 1/1992 | Miyaoka et al. | 60/468 X |

FOREIGN PATENT DOCUMENTS

| | | |
|---|---|---|
| 0309987 | 4/1989 | European Pat. Off. . |
| 410053A1 | 1/1991 | European Pat. Off. . |
| 59-55930 | 3/1984 | Japan . |
| 218485 | 2/1990 | Japan . |
| 2000326 | 1/1979 | United Kingdom . |

OTHER PUBLICATIONS

Patent Abstracts of Japan—Unexamined Applications, Jul. 11, 1987, vol. 11, No. 215, p. 24M606.

*Primary Examiner*—Edward K. Look
*Assistant Examiner*—Todd Mattingly
*Attorney, Agent, or Firm*—Oblon, Spivak, McClelland, Maier & Neustadt

[57] ABSTRACT

A slewing control device for a hydraulic slewing crane adapted to supply a discharge oil from a hydraulic pump through a slewing control valve to a slewing motor and control a rotational direction and a rotational speed of the slewing motor. The slewing control device includes a brake pressure control valve for variably controlling a discharge pressure of the slewing motor, an acceleration pressure control valve for variably controlling a suction pressure of the slewing motor, and a controller for outputting to both pressure control valves a pressure control signal to be determined according to an operational condition of the crane upon braking of a slewing body and controlling both the discharge pressure and the suction pressure of the slewing motor to control a pressure differential therebetween. Accordingly, even when a braking torque is small, the slewing body can be smoothly braked to be stopped at a target position accurately with no oscillation of a suspended load remaining.

3 Claims, 5 Drawing Sheets

SLEWING CONTROL DEVICE FOR CRANE

BACKGROUND OF THE INVENTION

The present invention relates to a slewing control device for a crane having a slewing body.

In a crane such as a hydraulic truck crane having a slewing body mounted on a traveling body and a multistage telescopic boom derrickably supported to the slewing body, a hoisting capacity of the crane varies with operational conditions such as a boom length, boom angle, outrigger expanded condition, and slewing angle. For example, when all of four outriggers of the truck crane are expanded at the maximum, the hoisting capacity can be desirably enhanced. However, when an expansion length of one or more of the outriggers is reduced according to a surrounding condition, the hoisting capacity in a slewing area corresponding to the reduced expansion length is reduced. Accordingly, it is necessary to limit a slewing range according to an expanded condition of each outrigger. Further, it is necessary to limit the slewing range so as to prevent a suspended load or the boom from contacting surrounding obstacles such as buildings. In this circumstance, it is demanded that slewing of the slewing body can be automatically stopped as required.

Conventionally, various devices for automatically stopping the slewing are known as follows:

(1) It is known from Japanese Patent Publication No. 60-20319, for example, that automatic stop of slewing is effected by setting a safe area and a dangerous area of slewing, outputting an automatic stop signal before the slewing reaches the dangerous area, and selecting an operational position of an electromagnetic closing valve by the signal to communicate a vent circuit of a main relief valve provided between a pump and a slewing direction selecting valve to a tank and thereby unload a discharge oil from the pump to the tank.

(2) It is known from Japanese Patent Laid-open Publication Nos. 62-31703 and 62-13619, for example, that a discharge pressure of a slewing motor is controlled by a variable relief valve or the like according to an inertia moment in braking and stopping the slewing, thereby controlling a braking torque.

(3) It is known from Japanese Utility Model Laid open Publication No. 2-18485, for example, that a discharge oil from the motor is unloaded in braking and stopping the slewing, and a discharge pressure of the motor is controlled by an electromagnetic proportional pressure control valve.

In the above prior art (1), when the automatic stop signal is input into the electromagnetic closing valve during the slewing, the discharge oil from the pump is unloaded to the tank. Accordingly, a pressure (accelerating pressure) on a suction side of a slewing motor can be made substantially zero. However, a pressure (brake pressure) on a discharge side of the slewing motor cannot be controlled. For this reason, if an operational position of the direction selecting valve is maintained at a slewing position, the slewing motor cannot be positively stopped but the slewing body continues to be rotated by inertia regardless of unloading the pump. Accordingly, it is necessary to mode the operational position of the direction selecting valve from the slewing position to a neutral block position, so as to positively stop the slewing body. If such a select operation is delayed, there is a danger that the slewing body will reach the dangerous area.

In the above prior art (2), the discharge pressure of the motor is controlled according to an inertia moment under the condition where a pressure oil to the motor is blocked upon braking of the slewing. However, although the discharge pressure of the motor can be controlled, the suction pressure of the motor cannot be controlled. Accordingly, a pressure differential between the discharge pressure and the suction pressure of the motor cannot be precisely controlled, with the result that it is difficult to stop the slewing body at a target position accurately.

Meanwhile, a slewing control system is classified into a neutral brake system wherein when the operational position of the direction selecting valve is returned to the neutral position, circuits on opposite sides of the slewing motor are blocked to stop the slewing and a neutral free system wherein when the operational position of the direction selecting valve is returned to the neutral position, the circuits on the opposite sides of the motor are communicated with each other to inertially rotate the motor (inertial slewing operation). In both the above prior arts (1) and (2), it is necessary to employ the slewing direction selecting valve, the device can be applied to the neutral brake system only.

In the above prior art (3), the discharge oil from the pump is unloaded upon braking of the slewing, and the discharge pressure of the slewing motor is variably controlled by the electromagnetic proportional pressure control valve. Accordingly, a pressure differential between the discharge pressure and the suction pressure of the slewing motor can be controlled more precisely than that in the prior arts (1) and (2), and the accuracy of braking and stopping can be made higher than that in the prior arts (1) and (2). Furthermore, the device in the prior art (3) can be applied to both the neutral brake system and the neutral free system. However, in the prior art (3), it has been found that when a total braking torque is small, there sometimes remains slight oscillation of a suspended load upon stoppage of the slewing body.

In braking the slewing, when the pressure differential between the discharge pressure and the suction pressure of the slewing motor becomes zero, the slewing (braking) torque becomes theoretically zero and the slewing motor is stopped to thereby stop the slewing body with no oscillation of the suspended load remaining. However, since there exists a peculiar braking torque due to an internal friction in the motor and an internal friction in a slewing speed reduction unit in a power transmitting system for slewing, a total braking torque (i.e., the sum of the peculiar braking torque and the hydraulic braking torque) cannot be completely zero in spite of the zero pressure differential. As a result, although the pressure differential is made zero, and the total braking torque is made apparently zero to stop the slewing, the oscillation of the suspended load is generated by the above mentioned remaining peculiar braking torque. Accordingly, in order to stop the slewing without leaving the oscillation of the suspended load, it is necessary to further reduce the total braking torque down to zero and make the pressure differential become smaller than zero.

None of the above prior art devices can control the brake operation so as to make the pressure differential become smaller than zero, that is, make the discharge pressure of the motor become lower than the suction pressure of the motor. In these circumstances, it is necessary to solve this problem.

SUMMARY OF THE INVENTION

It is accordingly an object of the present invention to provide a slewing control device for a crane which can automatically rapidly stop a slewing body even when the operational position of the direction selecting valve is in the slewing position in the case where the need to stop the slewing is generated during the slewing operation.

It is another object of the present invention to provide a slewing control device for a crane which permits an operator to interrupt the automatic stop control and preferentially effect a manual control for emergency stop, thereby improving the safety.

It is a further object of the present invention to provide a slewing control device for a crane which can be effectively applied to both the neutral brake system and the neutral free system.

It is a still further object of the present invention to provide a slewing control device for a crane which can precisely and smoothly stop the slewing body at a target position with no oscillation of a suspended load remaining even when the slewing (braking) torque is small.

According to the present invention, there is provided in a hydraulic slewing crane adapted to supply a discharge oil from a hydraulic pump through a slewing control valve to a slewing motor and control a rotational direction and a rotational speed of said slewing motor; a slewing control device for said crane comprising a brake pressure control valve for variably controlling a discharge pressure of said slewing motor; an acceleration pressure control valve for variably controlling a suction pressure of said slewing motor; and control means for outputting to both said pressure control valves a pressure control signal to be determined according to an operational condition of said crane upon braking of a slewing body and controlling both said discharge pressure and said suction pressure of said slewing motor to control a pressure differential therebetween.

In the above construction, said brake pressure control valve for variably controlling said discharge pressure of said slewing motor comprises an electromagnetic pressure reducing valve for outputting a secondary pressure according to the signal from said control means and a variable pressure control valve adapted to control a set pressure by employing said secondary pressure as an external pilot pressure.

Further, said acceleration pressure control valve for variably controlling said suction pressure of said slewing motor is provided in both a discharge passage of said hydraulic pump and a bleed-off passage of said slewing control valve.

In the braking operation of slewing, both the discharge pressure and the suction pressure of the slewing motor are simultaneously controlled through the brake pressure control valve and the acceleration pressure control valve by the signal from the control means, thereby controlling the pressure differential between the discharge pressure and the suction pressure of the slewing motor to automatically efficiently brake the slewing body. Particularly, even when the total braking torque is small, fine torque control can be carried out without being affected by a peculiar braking torque due to an internal friction or the like in the motor and the slewing speed reduction unit, by controlling the pressure differential to become negative, for example. Thus, the slewing body can be stopped accurately at a target position with no oscillation of the suspended load remaining. Further, since the braking control of slewing is carried out by the control of the discharge pressure and the suction pressure of the slewing motor, the braking control can be always effected properly irrespective of the fact that the slewing control valve is of a neutral brake system or a neutral free system.

Other objects and features of the invention will be more fully understood from the following detailed description and appended claims when taken with the accompanying drawings.

DETAILED DESCRIPTION OF THE PREFERRED EMBODIMENTS

Figure 2:
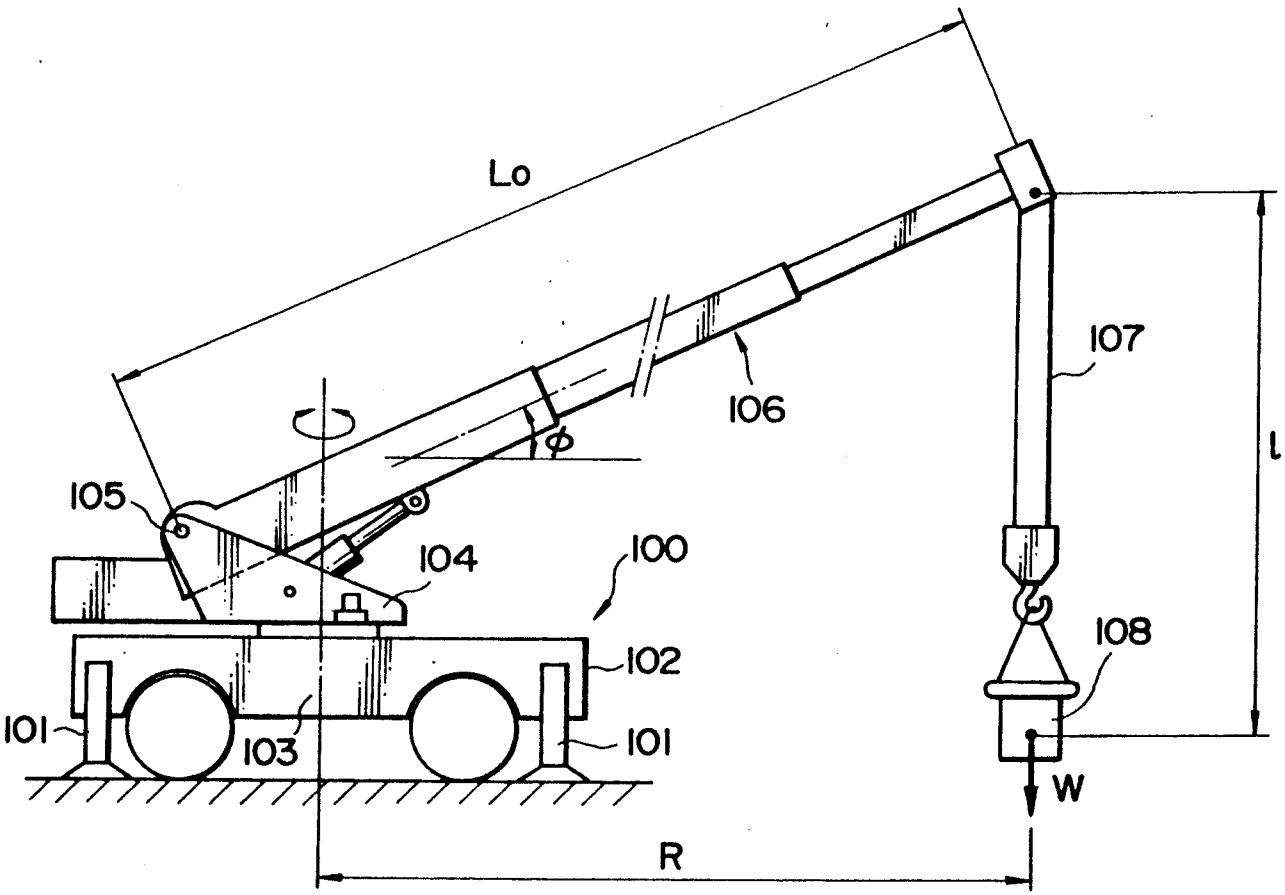
FIG. 2 is a side view of a crane by way of an example to which the device of the present invention is applied.

Referring first to FIG. 2, reference numeral 100 generally designates a crane to which the present invention is applied by way of an example. The crane 100 includes a traveling body 102 provided with outriggers 101 and a slewing body 104 mounted on the traveling body 102 and adapted to slew around a vertical axis 103. A telescopic boom 106 is supported to the slewing body 104 so as to be derrickable about a boom foot pin 105. A hoisting rope 107 is suspended from a free end (boom point sieve) of the boom 106, so that a suspended load 108 is raised or lowered by the hoisting rope 107.

Figure 3:
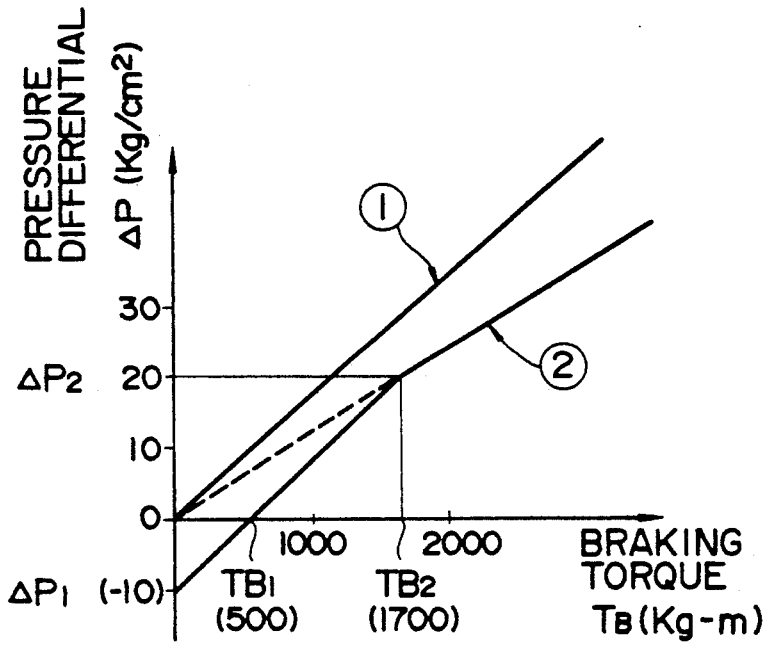
FIG. 3 is a graph showing the relationship between a pressure differential across the motor and a braking torque according to the present invention.

In the crane 100, a slewing operation of the slewing body 104 is carried out by a slewing motor 6 and a slewing speed reduction unit 67 of a slewing control device which will be hereinafter described. In braking the slewing, the slewing body 104, the boom 106 and the suspended load 108 continue to be slewed by inertia. Therefore, the motor 6 does not exhibit a motor operation due to a hydraulic pressure to be applied to a suction side of the motor 6, but it exhibits a pump operation generating a hydraulic pressure on a discharge side of the motor 6. FIG. 3 shows a relationship between a slewing torque or a braking torque $T_B$ and a pressure differential $\Delta P$ between a discharge pressure $P_B$ and a suction pressure $P_A$ of the motor 6 (i.e., $\Delta P = P_B - P_A$).

The braking torque $T_B$ is theoretically given by the following equation (1), and it is proportional to the pressure differential $\Delta P$ of the motor 6 as shown by a fine line (1) in FIG. 3.

$$T_B=\{(\Delta P\cdot q)/200\pi\}\times i_o \quad (1)$$

where, q: capacity of the motor 6

$i_o$: reduction ratio of the slewing speed reduction unit 67

However, since there exists an internal friction of the motor 6 and an internal friction of the slewing speed reduction unit 67 in the power transmitting system for slewing as mentioned above, the relationship between the braking torque $T_B$ and the pressure differential $\Delta P$ of the motor 6 is changed as shown by a heavy line (2) in FIG. 3 when the braking torque $T_B$ is small. As apparent from FIG. 3, even when the pressure differential $\Delta P$ is zero, a braking torque $T_{B1}$ is generated. Accordingly, it is necessary to control the slewing so that the pressure differential $\Delta P$ becomes a certain value $\Delta P_1$ smaller than zero so as to achieve $T_B=0$. It has been recognized by the present inventors that the Value $\Delta P_1$ is in the range of $-10$ to $-20$ (kg/cm$^2$) in general.

On the other hand, the following relationship is established between the braking torque $T_B$ and a slewing angular velocity $\omega$.

$$T_B = I_w(d\omega_w/dt) + Ic(d\omega_c/dt) \quad (2)$$

where, $I_w$: slewing inertia moment of the suspended load 108

Ic: slewing inertia moment of the slewing body 104 and the boom 106

$\omega_w$: slewing angular velocity of the suspended load 108

$\omega_c$: slewing angular velocity of the slewing body 104 and the boom 106

Figure 4:
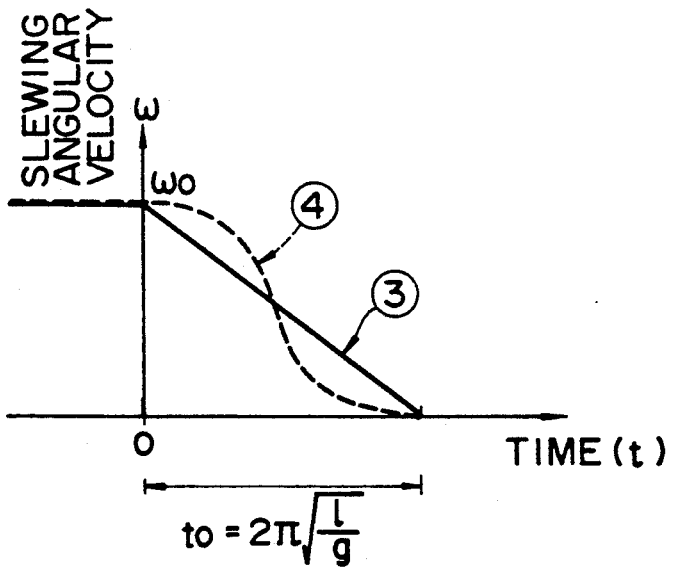
FIG. 4 is a graph showing the relationship between a slewing angular velocity and a time to be required till stoppage of a slewing body.

In order to stop the slewing body 104 without leaving oscillation of the suspended load 108 from the slewing condition of the slewing body 104 (inclusive of the boom 106) and the suspended load 108 with no oscillation thereof at an angular velocity of $\omega_o$, it is recognized that the slewing body 104 should be braked at a uniform angular acceleration as shown in FIG. 4. In this case, the angular velocity $\omega_c$ of the slewing body 104 is linearly reduced as shown by a solid line (3) in FIG. 4, while the angular velocity $\omega_w$ of the suspended load 108 is reduced along an oscillation waveform of one period as shown by a dashed line in FIG. 4. After the braking is started, and a period of time $t_0$ proceeds, both the angular velocity $\omega_c$ of the slewing body 104 and the angular velocity $\omega_w$ of the suspended load 108 becomes zero to result in stoppage of the slewing body 104 and the suspended load 108 without oscillation thereof. In other words, when the slewing body 104 slewing at the angular velocity $\omega_o$ is braked at a uniform angular acceleration, a period of time to be required for braking the slowing body 104 till stoppage thereof is $t_0$. In this case, the uniform angular acceleration is given by the following equation (3).

$$\omega_c=\omega_c-(\omega_c/t_o)\,t$$

$$d\omega_c/dt=-\omega_o/t_o \quad (3)$$

$$t_o=2\pi(1/g)^{\frac{1}{2}} \quad (4)$$

where, l: length of the hoisting rope 107 (distance from the center of the boom point sieve to the center of gravity of the suspended load 108)

g: gravitational acceleration

Further, the angular velocity $\omega_w$ of the suspended load 108 is expressed as follows:

$$\omega_w=\omega_0-(\omega_0/t_o)\{t-(1/g)^{\frac{1}{2}}\sin(g/l)^{\frac{1}{2}}t\}$$

$$d\omega_w/dt=-(\omega_0/t_o)\{1-\cos(g/l)^{\frac{1}{2}}t\} \quad (5)$$

Substituting the equations (3), (4) and (5) for the equation (2), the braking torque $T_B$ can be expressed as follows:

$$T_B=-(I_w\omega_0/2\pi)\cdot(g/l)^{\frac{1}{2}}\cdot\{1-\cos(g/l)^{\frac{1}{2}}t\}-(I_c\omega_0/2\pi)\cdot(g/l)^{\frac{1}{2}} \quad (6)$$

It is understood from the above equation (6) that the larger the length l of the hoisting rope and the smaller the slewing inertia moments $I_c$ and $I_w$ and the angular velocity $\omega_o$ at the starting of braking, the smaller the braking torque $|T_B|$.

In order to stop the slewing body 104 and the suspended load 108 at a target position in an actually usable range of the crane 100 without leaving the oscillation of the suspended load 108, it is sometimes necessary to brake the slewing body with a braking torque smaller than the braking torque |TB| shown in FIG. 3. To meet the above necessity, the following slewing control device is employed in the preferred embodiment.

Figure 1:
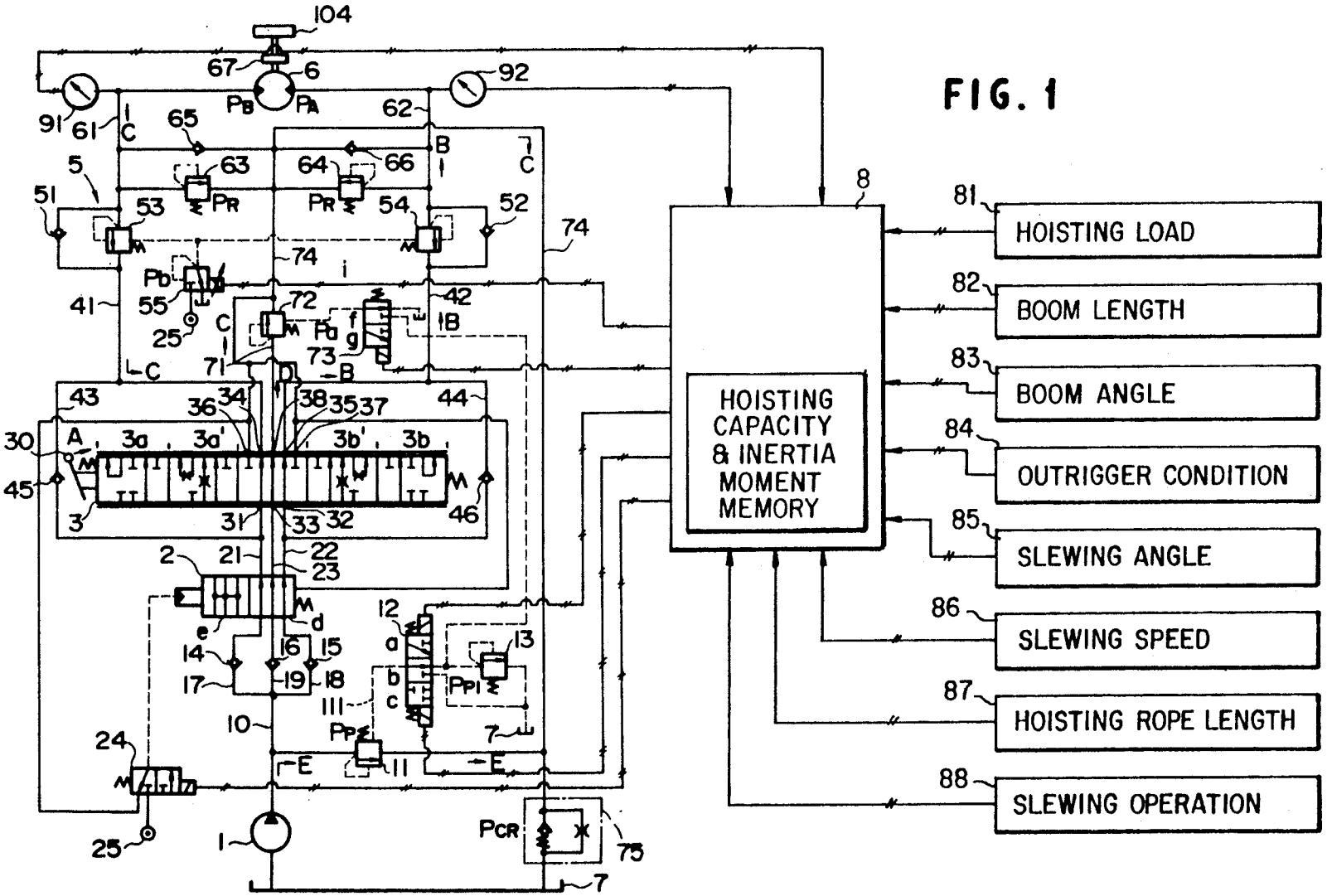
FIG. 1 is a hydraulic circuit diagram showing a preferred embodiment of the present invention.

FIG. 1 is a hydraulic circuit diagram showing the preferred embodiment of the present invention. The device of the present invention is effectively applicable to both the neutral brake system and the neutral free system. Accordingly, the following description of the present invention is directed, for the convenience of explanation, to a preferred embodiment applied to a circuit which can selectively employ the neutral brake system and the neutral free system.

Referring to FIG. 1, the hydraulic circuit includes a hydraulic pump 1, a mode selecting valve 2 for selecting a neutral brake mode or a neutral free mode, a slewing direction selecting valve 3, a slewing motor 6, a tank 7, and a controller (control means) 8. The slewing body 104 (see FIG. 2) is connected through the slewing speed reduction unit 67 to the motor 6.

A variable main relief valve 11 for variably controlling a discharge pressure of the pump 1 is connected to a discharge passage 10 of the pump 1, and a back pressure valve 75 having a set pressure (cracking pressure) $P_{CR}$ (5 kg/cm$^2$) is connected to a return passage 74 leading to the tank 7. The variable main relief valve 11 is normally constructed by a balance piston type unload relief valve consisting of a main valve and a subvalve (not shown). A three-position selector valve 12 is connected to a vent passage 111 of the subvalve, so as to variably control a set pressure $P_p$ of the variable main relief valve 11. The three-position selector valve 12 is adapted to select one of three positions consisting of a position a for communicating the vent passage 111 with a drain passage leading to the tank 7, a position b for communicating the vent passage 111 with a set pressure controlling relief valve 13, and a position c for blocking the vent passage 111, according to a signal from the controller 8.

Accordingly, the relief set pressure $P_p$ of the variable main relief valve 11 is selected to one of three stages consisting of a minimum set pressure $P_{p0}$ (0 kg/cm$^2$) corresponding to the position a of the three-position selector valve 12, a set pressure $P_{p1}$ (20 kg/cm$^2$) corresponding to the position b which set pressure is to be determined by the back pressure relief valve 13, and a maximum set pressure $P_{p2}$ (210 kg/cm$^2$) corresponding to the position c. Thus, the discharge pressure of the pump 1 is controlled by the variable main relief valve 11, the set pressure selector valve 12 and the back pressure relief valve 13, with the result that a suction pressure of the motor 6 is controlled by the acceleration pressure control valve constituted by the above valves 11, 12 and 13 according to the present invention.

The discharge passage 10 of the pump 1 is connected in parallel to first, second and third branch passages 17, 18 and 19 having check valves 14, 15 and 16, respectively. The mode selecting valve 2 is constructed by a pilot selector valve adapted to select either a position d (neutral brake mode) where the first, second and third branch passages 17, 18 and 19 are individually communicated with intermediate passages 21, 22 and 23, respectively, or a position e (neutral free mode) where the first, second and third branch passages 17, 18 and 19 are all communicated with the intermediate passages 21, 22 and 23. Reference numerals 24 and 25 designate an electromagnetic selector valve and an operating hydraulic power source for operating the mode selecting valve 2, respectively.

The slewing direction selecting valve 3 is normally constructed by a 8-port 3-position selector valve adapted to select a slewing position 3*a* or 3*b* from a neutral position by operating an operating lever 30. Reference numerals 3*a*' and 3*b*' designate transient positions. First, second and third ports 31, 32 and 33 of the valve 3 are connected to the intermediate passages 21, 22 and 23. Fourth and fifth ports 34 and 35 of the valve 3 are connected to motor side passages 41 and 42. Sixth and seventh ports 36 and 37 of the valve 3 are connected to the return passage 74 leading to the tank 7. An eighth port 38 of the valve 3 is connected to a bleed-off passage 71. Reference numerals 43 and 44 designate bypass passages having check valves 45 and 46 respectively. The slewing control valve according to the present invention is constituted by the mode selecting valve 2, the direction selecting valve 3 and the check valves 14, 15, 16, 45 and 46.

The bleed-off passage 71 of the direction selecting valve 3 is connected to a variable pressure control valve 72, and an outlet of the valve 72 is connected to the return passage 74. A vent passage of the variable pressure control valve 72 is connected to a two-position selector valve 73 adapted to be operated by the signal from the controller 8 so that a set pressure $P_a$ of the valve 73 is controlled in two stages. That is, when the selector valve 73 is operated to select a position f, the vent passage of the variable pressure control valve 72 is connected to the drain passage leading to the tank 7, and the set pressure $P_a$ becomes a minimum set pressure $P_{ao}$ (4 kg/cm$^2$) lower than the set pressure $P_{CR}$ (5 kg/cm$^2$) of the back pressure valve 75. When the selector valve 73 is operated to select a position g, the vent passage of the valve 72 is connected to a primary side of the set pressure controlling relief valve 13, and the set pressure $P_a$ becomes the set pressure $P_{p1}$ (20 kg/cm$^2$) to be determined by the relief valve 13.

In the preferred embodiment, the set pressure controlling relief valve 13 is commonly employed for controlling the pressure in both the discharge passage 10 of the pump 1 and the bleed off passage 71 for the purpose of reducing a cost. However, it is naturally provided to an individual relief valve as the pressure control valve for the bleed-off passage 71. Further, by suitably setting an opening degree of the bleed-off passage of the direction selecting valve 3, the pump pressure can be maintained at a high value to some extent even when a bleed-off quantity is present. In this case, both the variable pressure control valve 72 and the two-position selector valve 73 may be omitted.

Figure 5:
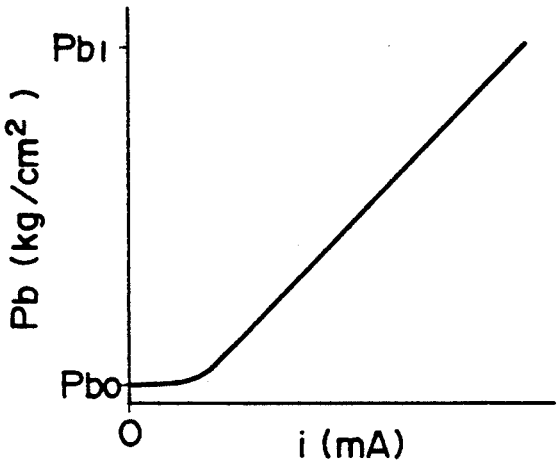
FIG. 5 is a graph showing a control characteristic of a variable pressure control valve as the brake pressure control valve according to the present invention.
Figure 6:
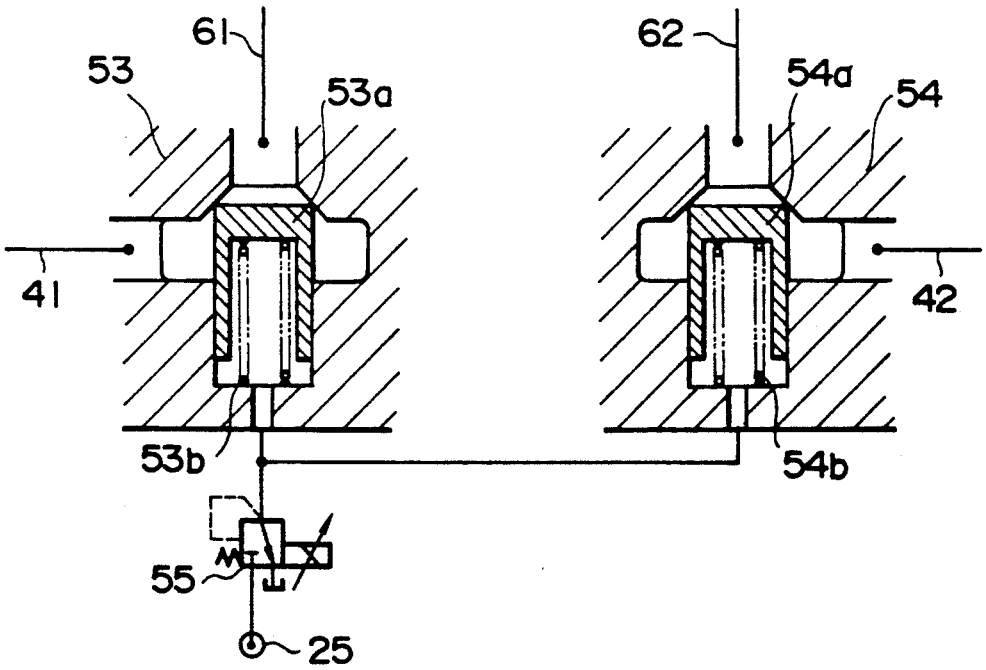
FIG. 6 is a hydraulic circuit diagram of an essential part of a preferred embodiment of the brake pressure control valve.

There are provided between the oil passages 41 and 61 which are connected between the direction selector valve 3 and the motor 6 a check valve 51 and a variable pressure control valve 53 connected in parallel to each other. Similarly, there are provided between the oil passages 42 and 62 a check valve 52 and a variable pressure control valve 54 connected in parallel to each other. The check valves 51 and 52 permit flow of the oil from the direction selector valve 3 to the motor 6. The variable pressure control valves 53 and 54 are constructed by poppet valves as shown in FIG. 6. Referring to FIG. 6, oil chambers of poppets 53*a* and 54*a* on the side of springs 53*b* and 54*b* are connected to a secondary side of an electromagnetic proportional pressure reducing valve 55, and an operating hydraulic pressure source 25 is connected to a primary side of the electromagnetic proportional pressure reducing valve 55. The electromagnetic proportional pressure reducing valve 55 is adapted to output a secondary pressure according to a control signal (current i) from the controller 8, so that the valve 55 controls a set pressure $P_b$ of the variable pressure control valves 53 and 54 continuously in the range from a minimum set pressure $P_{b0}$ (4 kg/cm$^2$) to a maximum set pressure $P_{b1}$ (190 kg/cm$^2$) as shown in FIG. 5 by employing the secondary pressure of the valve 55 as an external pilot pressure. Thus, the brake pressure control valve according to the present invention is constituted by the variable pressure control valves 53 and 54 and the electromagnetic proportional pressure reducing valve 55 to control a pressure of the discharge oil from the motor 6 to the direction selecting valve 3 (i.e., a brake pressure). The use of the poppet type variable pressure control valves 53 and 54 is advantageous because oil leakage can be eliminated and a difference between an outer diameter of the poppets 53*a* and 54*a* and a seat diameter can also be eliminated in comparison with a standard electromagnetic proportional relief valve. Accordingly, the set pressure of the variable pressure control valves 53 and 54 can be precisely controlled without influence of the pressure in the downstream oil passages 41 and 42.

Reference numerals 63 and 64 designate overload relief valves. A set pressure $P_R$ of the overload relief valves 63 and 64 is set to a value (200 kg/cm$^2$) lower than the maximum set pressure $P_{P2}$ of the variable main relief valve 11 and higher than the maximum set pressure $P_{b1}$ of the variable pressure control valves 53 and 54. Reference numerals 65 and 66 designate anti-cavitation check valves, and reference numerals 91 and 92 designate pressure sensors.

The crane 100 shown in FIG. 2 further includes a sensor 81 for a hoisting load W, a sensor 82 for a boom length $L_O$, a sensor 83 for a boom angle $\phi$, a sensor 84 for an expanded condition of the outriggers, a sensor 85 for a slewing angle, a sensor 86 for a slewing speed (angular velocity $\omega$), a sensor 87 for a hoisting rope length 1, and a sensor 88 for slewing operation (lever operation switch). The number and the combination of these sensors are not limited to the above, but they may be arbitrarily changed and selected according to a kind of the crane or as desired.

The operation of the preferred embodiment will now be described.

I. NEUTRAL BRAKE MODE

(a)

Under the condition where the electromagnetic selector valve 24 is unexcited to maintain the position d (neutral brake mode) of the mode selecting valve 2 as shown in FIG. 1, the lever 30 is operated in a direction depicted by an arrow A to select the direction selecting valve 3 toward the slewing position 3a. At the transient position 3a' of the direction selecting valve 3, an amount of the discharge oil from the pump 1 according to a spool stroke is allowed to pass the ports 32 and 35 and flow in a direction depicted by an arrow B into the slewing motor 6. Accordingly, the slewing motor 6 is accelerated in a clockwise direction, for example, and a discharge oil from the motor 6 is allowed to flow in a direction depicted by an arrow C and is returned to the tank 7. At this time, the remaining amount of the discharge oil from the pump 1 is bled off from the port 33 through a restriction (notch) of a spool to the port 38, and is allowed to flow in a direction depicted by an arrow D and is returned to the tank 7.

In such a normal slewing operation at acceleration without automatic control of braking (deceleration and stoppage) of the slewing, the select position of the two-position selector valve 73 is maintained a the position f by the signal from the controller 8, and accordingly the set pressure $P_a$ of the variable pressure control valve 72 is maintained at the minimum set pressure $P_{a0}$ (4 kg/cm$^2$). Further, the select position of the set pressure selector valve 12 is maintained at the position c by the signal from the controller 8, and accordingly the set pressure $P_p$ of the variable main relief valve 11 is maintained at the maximum set pressure $P_{p2}$ (210 kg/cm$^2$). Further, the signal i to be output from the controller 8 to the electromagnetic proportional pressure reducing valve 55 is zero, and accordingly the set pressure $P_b$ of the variable pressure control valve 53 (54) is maintained at the minimum set pressure $P_{b0}$ (4 kg/cm$^2$).

Accordingly, an amount of the oil according to the spool stroke of the direction selector valve 3 is sucked into the motor 6 under a suitable pressure not greater than the maximum set pressure $P_{p2}$ of the variable main relief valve 11, and the motor 6 is accelerated by a pressure (acceleration pressure) corresponding to a load due to the slewing body and the like. At this time, a back pressure corresponding to the minimum set pressure $P_{b0}$ (4 kg/cm$^2$) of the variable pressure control valve 53 is applied to the discharge side of the motor 6. However, since the minimum set pressure $P_{b0}$ is set to a value smaller than the set pressure $P_{CR}$ (5 kg/cm$^2$) of the back pressure valve 75 downstream of the valve 53, a pressure differential across the variable pressure control valve 53 becomes zero. Accordingly, the discharge oil from the motor 6 is smoothly returned to the tank 7 without interference with the variable pressure control valve 53 in the same manner as under normal slewing control.

(b) Automatic Braking of Slewing

During the above slewing operation, the controller 8 determines whether or not the slewing body 104 needs to be braked according to detection signals from the sensors 81 to 88, 91 and 92, a hoisting capacity and a slewing inertia moment of the crane 100 preliminarily stored in a memory. If it is determined that the braking of the slewing body 104 is necessary, the controller 8 outputs the control signal i of a predetermined pattern to the electromagnetic proportional pressure reducing valve 55, and also outputs the select signals to the selector valves 12 and 73. More specifically, the controller 8 first computes a required stop point of the slewing body 104 or a stop point just prior to the required stop point as a target stop point, and also computes the optimum time $t_0$ to be required for making the angular velocity $\omega$ of the slewing body 104 becomes zero. Further, the controller 8 computes the braking torque $T_B$ from the above equation (6), and outputs the above signals so as to automatic brake control with the braking torque $T_B$ at a timing before the time $t_0$ from the target stop point.

Then, a suction pressure $P_A$ and a discharge pressure $P_B$ of the motor 6 are controlled according to the braking torque $T_B$ in the following manner.

(b-1) Large Braking Torque $T_B$

When the braking torque $T_B$ is equal to or larger than a reference point $T_{B2}$ (1700 kg-m) shown in FIG. 3, the selector valve 12 is operated to select the position a by the signal from the controller 8, thereby controlling the set pressure $P_p$ of the variable main relief valve 11 to the minimum set pressure $P_{p0}$ (0 kg/cm$^2$). The selector valve 73 is maintained at the position f, thereby maintaining the set pressure $P_a$ of the pressure control valve 72 at the minimum set pressure $P_{a0}$ (0 kg/cm$^2$). Therefore, if the direction selecting valve 3 is operated to select the slewing position 3a, the discharge oil from the pump 1 is unloaded under the set pressures $P_{p0}$ and $P_{a0}$ (both are 0 kg/cm$^2$), and the suction pressure (acceleration pressure) $P_A$ of the motor 6 becomes 0 kg/cm$^2$.

On the other hand, the signal i is output from the controller 8 to the electromagnetic proportional pressure reducing valve 55 according to the braking torque $T_B$ on the discharge side of the motor 6, so that the secondary pressure of the valve 55 is controlled, and the set pressure $P_b$ of the variable pressure control valve 53 is controlled as shown in FIG. 5 by employing the secondary pressure as a pilot pressure. When the signal i to be output into the electromagnetic proportional pressure reducing valve 55 is zero, and the set pressure $P_b$ of the variable pressure control valve 53 is therefore controlled to the minimum set pressure $P_{b0}$ (4 kg/cm$^2$), a pressure differential across the variable pressure control valve 53 becomes zero because the set pressure $P_{CR}$ of the back pressure valve 75 is 5 kg/cm$^2$. Accordingly, even if a line resistance on the downstream side of the valve 53 is 5 kg/cm$^2$, for example, the discharge pressure Ps of the motor 6 on the upstream side of the valve 53 becomes 10 kg/cm$^2$ at the minimum. Accordingly, the automatic brake control is started from the condition where the signal i is zero, and the pressure differential $\Delta P$ between the suction pressure $P_A$ and the discharge pressure $P_B$ of the motor 6 is 10 kg/cm$^2$. Further, as the set pressure $P_b$ of the variable pressure control valve 53 is controlled in the range of 4 to 190 kg/cm$^2$ (see FIG. 5) by increasing the signal i to be input into the electromagnetic proportional pressure reducing valve 55 according to the braking torque $T_B$, the discharge pressure $P_B$ of the motor 6 is controlled in the range of 10–190 kg/cm$^2$.

Thus, the automatic brake control can be carried out under the pressure differential $\Delta P \geqq 10$ kg/cm$^2$ with the braking torque $T_B \geqq 1700$ kg-m by controlling the discharge pressure $P_B$ and the suction pressure $P_A$ of the motor 6. Accordingly, the slewing body 104 can be efficiently braked to be stopped at the target stop point quickly and reliably with n oscillation of the suspended load remaining.

(b-2) Small Braking Torque $T_B$

When the braking torque $T_B$ is smaller than the reference point $T_{B2}$ (1700 kg-m) shown in FIG. 3, the selector valve 12 and the selector valve 73 are operated to select the position b and the position g, respectively, by the signals from the controller 8, so that the set pressure $P_p$ of the variable main relief valve 11 and the set pressure $P_a$ of the variable pressure control valve 72 in the bleed off passage 71 are controlled to the set pressure $P_{p1}$ (20 kg/cm$^2$) of the set pressure controlling relief valve 13. Therefore, the discharge oil from the pump 1 is unloaded under the set pressure $P_{p1}$ (20 kg/cm$^2$), and the suction pressure (acceleration pressure) $P_A$ of the motor 6 becomes 20 kg/cm$^2$.

The discharge pressure $P_B$ of the motor 6 is controlled in the same manner as in the above case (b-1). When the signal i from the controller 8 is zero, the discharge pressure $P_B$ is controlled to 10 kg/cm$^2$ by the set pressure $P_{CR}$ (5 kg/cm$^2$) of the back pressure valve 75 and the line resistance (5 kg/cm$^2$) downstream of the variable pressure control valve 53. Accordingly, the pressure differential $\Delta P$ across the motor 6 becomes as follows:

$$\begin{aligned} \Delta P &= P_B - P_A \\ &= 10 - 20 = -10\ (\text{kg/cm}^2) \end{aligned} \quad (1)$$

By controlling the set pressure $P_b$ of the variable pressure control valve 53 by increasing the signal i, fine torque control can be carried out under the pressure differential $\Delta P \geqq -10$ kg/cm$^2$, that is, with the braking torque $T_B \geqq 0$ kg-m as shown by the heavy line (2) in FIG. 3. Accordingly, even when the slewing inertia moments $I_W$ and $I_c$ of the suspended load 108 and the slewing body 104 are small, or the hoisting rope length 1 is large, the slewing body 104 can be smoothly braked to be stopped at a target position with no oscillation of the suspended load 108 remaining.

(c) Manual Stop of Slewing (Neutral Brake)

When the operational position of the direction selecting valve 3 is returned from the slewing position 3a toward a neutral position after the acceleration of the motor 6, the discharge oil leading from the motor 6 in the direction D is returned through the direction selecting valve 3 to the tank 7, wherein the flow amount of the discharge oil is restricted by the restriction of the spool on a meter-out side. At this time, a part of the discharge oil from the motor 6 is allowed to flow from the passage 41 into the bypass passage 43. However, as the mode selecting valve 2 is in the position d in the neutral brake mode as shown in FIG. 1, the discharge oil having entered the bypass passage 43 is blocked by the check valve 14. Accordingly, only one passage leading from the port 34 to the port 36 is opened on the meter-out side. While the operational position of the direction selecting valve 3 is being returned from the slewing position 3a to the transient position 3a', the discharge oil from the motor 6 is restricted by the restriction on the meter-out side to be returned to the tank 7. Thus, the pressure in the passage 41 is controlled by such meter-out control, and the motor 6 is braked. On the other hand, a part of the discharge oil from the pump 1 is returned to the tank 7 under bleed-off control, and simultaneously a required flow amount of the motor 6 is fed to the motor 6.

Thereafter, when the operational position of the direction selecting valve 3 is fully returned to the neutral position, the restriction on the meter-out side is closed. Therefore, the discharge oil from the motor 6 is relieved through the overload relief valve 63 to the tank 7. As a result, a brake pressure corresponding to the set pressure $P_R$ (200 kg/cm$^2$) of the relief valve 63 is applied to the motor 6, thereby rapidly stopping the motor 6, that is, the slewing body. On the other hand, the discharge oil from the pump 1 is returned in the direction E to the tank 7 under bleed-off control, and simultaneously a required amount of the oil is supplied through the anti-cavitation check valve 66 to the suction side of the motor 6 until the motor 6 is stopped.

Meanwhile, under the automatic stop control of slewing as mentioned above in the section (b), when the operational position of the direction selecting valve 3 is returned from the slewing position 3a to the neutral position, the pressure in the passage 41 downstream of the variable pressure control valve 53 is increased by the meter-out control of the direction selecting valve 3. However, since the downstream side of the electromagnetic proportional pressure reducing valve 55 connected to the vent passage of the valve 53 is connected to the drain, and the set pressure $P_b$ is accordingly controlled in an absolute pressure fashion rather than a differential pressure fashion, the set pressure $P_b$ is not influenced by the pressure in the passage 41 downstream of the variable pressure control valve 53, but it is properly controlled according to the signal i from the controller 8. Thus, the automatic stop control of slewing is properly carried out according to the signal i from the controller 8.

However, in the case where an operator notices a danger to return the lever 30 to the neutral position at once under the automatic stop control, the pressure in the passage 41 subjected to the meter-out control of the direction selecting valve 3 is increased to a value higher than the set pressure $P_b$ of the variable pressure control valve 53 controlled by the signal i from the controller 8, and the motor 6 is braked by the higher pressure, that is, the meter-out controlled pressure. Thus, even under the automatic control, the operator can interrupt the automatic control to preferentially effect the manual control for emergency stop.

II. NEUTRAL FREE MODE (a) Slewing Acceleration

When the electromagnetic selector valve 24 is excited to select its right position, the hydraulic oil from the operating hydraulic power source 25 is supplied to a pilot portion of the mode selecting valve 2 to select the position e (neutral free mode) of the mode selecting valve 2. At this time, the three-position selector valve 12 is maintained at the position c to thereby maintain the maximum set pressure $P_{p2}$ of the variable main relief valve 11. Further, the two-position selector valve 73 is maintained at the position f to maintain the minimum set pressure $P_{a0}$ of the variable pressure control valve 72. Further, the control signal i from the controller 8 is zero, and the set pressure $P_b$ of the variable pressure control valve 53 is maintained al the minimum set pressure $F_{b0}$. Under the condition, when the lever 30 is moved in the direction A to select the slewing position 3a of the direction selecting valve 3, the motor 6 is acceleratively rotated to slew the slewing body in substantially the same manner as at the accelerating operation in the neutral brake mode mentioned in the above case I-(a).

(b) Inertial Slewing

After acceleration of rotation of the motor 6, when the direction selecting valve 3 is returned from the slewing position 3a to the neutral position, the motor 6 continues to be rotated by inertia. Accordingly, the discharge oil from the motor 6 is fed in the direction C to the variable pressure control valve 53. At this time, as the signal i from the controller 8 is zero, and the set pressure $P_b$ of the variable pressure control valve 53 is maintained at the minimum set pressure $P_{b0}$, no braking operation by the variable pressure control valve 53 is effected, and the discharge oil from the motor 6 passes the variable pressure control valve 53 to be fed to the direction selecting valve 3.

At the transient position 3a' of the direction selecting valve 3, the discharge oil fed from the motor 6 is returned through the port 34 and the port 36 to the tank 7, wherein a flow amount is restricted by the restriction of the spool. At this time, however, a part of the discharge oil is fed through the bypass passage 43 and the position e of the mode selecting valve 2 to the port 33, thereafter being returned through the port 37 to the tank 7. Accordingly, even when the direction selecting valve 3 is returned from the slewing position 3a to the transient position 3a', the total flow amount on the meter-out side is not restricted. Further, the set pressure $P_b$ of the variable pressure control valve 53 is maintained at the minimum set pressure $P_{b0}$, and the cracking pressure $P_{CR}$ of the back pressure valve 75 is set at a value greater than the minimum set pressure $P_{b0}$, which increases a general system pressure. Therefore, no undue back pressure (brake pressure) by the variable pressure control valve 53 is applied to the discharge side of the motor 6, thus ensuring smooth inertial rotation of the motor 6. On the other hand, the remaining part of the discharge oil fed from the pump 1 through the ports 33 and 37 to the tank 7 under bleed-off control and a part of the discharge oil fed from the motor 6 through the bypass passage 43 and the position e of the mode selecting valve 2 to the port 32 are fed together to the suction side of the motor 6. Therefore, the motor 6 is continuously smoothly rotated by inertia.

Thereafter, when the direction selecting valve 3 is returned from the transient position 3a' to the neutral position, all the ports 31 to 38 of the direction selecting valve 3 are communicated with each other through the position e of the mode selecting valve 2. Accordingly, the discharge oil from the pump 1 is fed in the direction D to be bled off to the tank 7, and no driving pressure is generated on the suction side of the motor 6. However, as the motor 6 continues to be rotated by inertia, the discharge oil from the motor 6 is allowed to flow through the bypass passage 43, the position e of the mode selecting valve 2, and the neutral position of the direction selecting valve 3 to the suction side of the motor 6. Accordingly, the motor 6 is not stopped at once, but is rotated by inertia to effect the inertial slewing, thereafter the slewing body 104 being gradually stopped by an external force such as by wind and a line resistance to the oil.

(c) Automatic Stop of Slewing

During the slewing acceleration and the inertial slewing, when the automatic stop signal i is output from the controller 8, the three-position selector valve 12 is selected to its position a to unload the discharge oil from the pump 1 to the tank 7 and simultaneously control the set pressure $P_b$ of the variable pressure control valve 53 by the signal i from the controller 8 as shown in FIG. 3 by the operation similar to the automatic stop operation in the neutral brake mode. Accordingly, even when the direction selecting valve 3 is maintained in the slewing position 3a, the discharge pressure of the pump 1, i.e., the suction pressure (accelerating pressure) of the motor 6 is substantially zero, and the discharge pressure (brake pressure) of the motor 6 is controlled to brake the motor 6 with the braking torque $T_B$ according to the pressure differential $\Delta P$ across the motor 6.

(d) Manual Stop of Slewing (Counter Lever)

During the inertial slewing as mentioned in the section (b), when the slewing body, that is, the motor 6 is intended to be rapidly stopped, the lever 30 is operated in a direction counter to the direction A (counter lever operation) to select a position 3b via a position 3b' of the direction selecting valve 3. At the transient position 3b' of the direction selecting valve 3, the discharge oil from the motor 6 is fed through the bypass passage 43, and the position e of the mode selecting valve 2 to the port 33 of the direction selecting valve 3, thereafter flowing through the restriction of the spool, the port 38 and the variable pressure control valve 72 (maintained at the minimum set pressure $P_{a0}$) to the tank 7. Such a spool restricting operation brakes the motor 6. On the other hand, the discharge oil from the pump 1 is joined with the discharge oil from the motor 6 at the position e of the mode selecting valve 2, and they are bled off through the port 33 of the direction selecting valve 3 and the port 38 to the tank 7 as being subjected to the spool restricting operation. Thus, the brake pressure can be controlled by selecting the position 3b' of the direction selecting valve 3 by the counter lever operation. Furthermore, when the position 3b is selected, a maximum brake pressure to be determined by the overload relief valve 63 can be exhibited. In this manner, the motor 6 can be braked by a brake pressure corresponding to a counter lever stroke.

Meanwhile, during the automatic stop operation as mentioned in the section II-(c), when the operator notices a danger to carry out the counter lever operation as mentioned in the section (d) so that the bleed-off passage of the direction selecting valve 3 is restricted to make the pressure in the passages 41 and 61 higher than the set pressure $P_b$ of the variable pressure control valve 53, the motor 6 can be braked by the manual operation (counter lever operation) in the same manner as that in the neutral brake mode. Thus, even under the automatic control, the operator can interrupt the automatic control to preferentially effect the manual control for emergency stop.

In principle, the crane is placed on a horizontal ground to be used with no inclination of a machine body. However, there is a case that the machine body is slightly inclined during the operation of the crane. In this case, it is necessary to add influence of the inclination of the machine body to the control of the braking torque. Particularly in the case of braking the slewing body in an ascending direction of the inclination, there is a fear that a braking force becomes excessive only by the control of the suction pressure of the motor 6. However, in such a case, by additionally carrying out the control of the discharge pressure of the motor 6 according to a using condition of the crane, the slewing body can be braked to be stopped at a target position with no oscillation of the suspended load.

Further, the set pressure of each valve and the other values as mentioned above are merely exemplary. They are not limited to the above values but may be arbitrarily set.

Figure 7A:
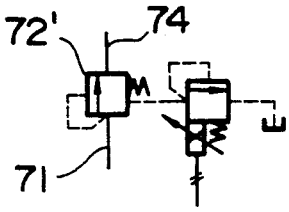
FIGS. 7A and 7B are hydraulic circuit diagrams of another preferred embodiment of the variable pressure control valves to be provided in the bleed-off passage and the discharge passage of the pump, respectively.
Figure 7B:
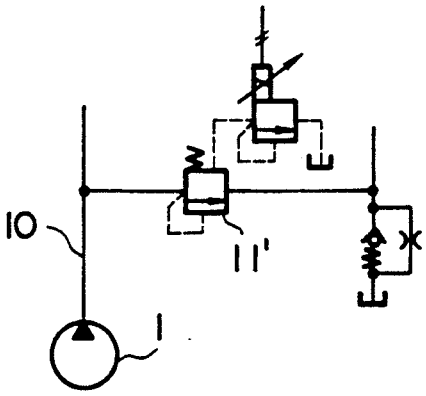

In the above preferred embodiment, the set pressure of the variable pressure control valve 11 provided in the discharge passage 10 of the pump 1 is stepwise controlled by the three-position selector valve 12 and the set pressure controlling relief valve 13. Similarly, the set pressure of the variable pressure control valve 72 provided in the bleed-off passage 71 is stepwise controlled by the two-position selector valve 73. In another preferred embodiment as shown in FIGS. 7A and 7B, the variable pressure control valves 72 and 11 may be constructed by electromagnetic proportional pressure control valves 72' and 11', respectively, adapted to control the set pressures continuously.

The device of the present invention may be, of course, applied to a neutral brake dedicated type and a neutral free dedicated type.

As described above, when the need of stopping the slewing body is generated during the slewing operation, the discharge pressure and the suction pressure of the motor are controlled to thereby control a pressure differential therebetween. Accordingly, the motor can be automatically braked with a predetermined braking torque, thus braking the slewing body quickly. In particular, the braking control can be carried out without being affected by an internal friction of the motor and a peculiar braking torque of the slewing speed reduction unit or the like by controlling the pressure differential. Further, even when the braking torque is small, the braking operation can be precisely controlled to thereby stop the slewing body at a target position accurately with no oscillation of the suspended load remaining. Further, even under the automatic control, the operator can interrupt the automatic control to preferentially effect a manual control for emergency stop, thus improving the operability and the safety. Further, the device of the present invention can be applied to both the neutral brake system and the neutral free system, and the automatic stop of slewing can be effected in both the systems. Thus, a general-purpose performance of the device can be improved.

Additionally, the brake pressure control valve for controlling the discharge pressure of the slewing motor is constructed by the electromagnetic proportional pressure reducing valve adapted to output a secondary pressure according to the control signal from the control means and a variable pressure control valve adapted to control a set pressure by employing the secondary pressure as an external pilot pressure. Accordingly, no internal leakage in the variable pressure control valve is generated to thereby improve the accuracy of the braking control.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a hydraulic slewing crane adapted to supply a discharge oil from a hydraulic pump through a slewing control valve to a slewing motor and control a rotational direction and a rotational speed of said slewing motor, a slewing control device for said crane comprising:

a brake pressure control valve for variably controlling a discharge pressure of said slewing motor;

an acceleration pressure control valve for variably controlling a suction pressure of said slewing motor; and control means for outputting to both said pressure control valves a pressure control signal to be determined according to an operational condition of said crane upon braking of a slewing body and controlling both said discharge pressure and said suction pressure of said slewing motor to control a pressure differential therebetween such that the pressure differential has a negative minimum value.

2. The slewing control device as defined in claim 1, wherein said brake pressure control valve for variably controlling said discharge pressure of said slewing motor comprises an electromagnetic pressure reducing valve for outputting a secondary pressure according to the signal from said control means and a variable pressure control valve adapted to control a set pressure by employing said secondary pressure as an external pilot pressure.

3. The slewing control device as defined in claim 1 or 2, wherein said acceleration pressure control valve for variably controlling said suction pressure of said slewing motor is provided in both a discharge passage of said hydraulic pump and a bleed-off passage of said slewing control valve.

* * * * *